United States Patent [19]

Klemz

[11] 4,141,112

[45] Feb. 27, 1979

[54] DOCTORS FOR PAPER-MAKING MACHINES

[75] Inventor: David B. Klemz, Cowden, near Edenbridge, England

[73] Assignee: Vickerys Limited, England

[21] Appl. No.: 870,505

[22] Filed: Jan. 18, 1978

[30] Foreign Application Priority Data

Feb. 7, 1977 [GB] United Kingdom ..... 4931/77

[51] Int. Cl.[2] ..... D21C 3/02

[52] U.S. Cl. ..... 15/256.51; 162/281

[58] Field of Search ..... 15/256.51; 104/425; 100/174; 165/91; 162/281; 118/261, 100; 241/167

[56] References Cited

U.S. PATENT DOCUMENTS 3,164,492 1/1965 Schmitt et al. ..... 15/256.51 X

FOREIGN PATENT DOCUMENTS 990670 4/1965 United Kingdom ..... 15/256.51

*Primary Examiner*—Edward L. Roberts

*Attorney, Agent, or Firm*—Watson, Cole, Grindle & Watson

[57] ABSTRACT

A doctor comprising a support, a blade holder including a tang, disposed adjacent the support, a doctor blade supported in the blade holder, the support and the tang having opposed flat surfaces, a series of spacers spaced along the length of the doctor, each of which is adjustable to vary the spacing between the said flat surfaces while maintaining them parallel, and means for securing each spacer in adjusted position.

2 Claims, 1 Drawing Figure

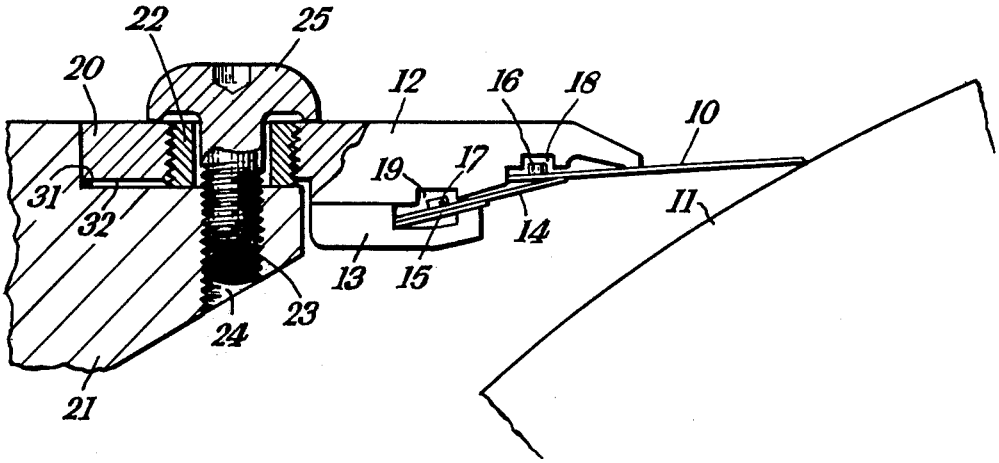
22
25
20
12
16
18
10
19
17
31
32
11
14
13
15
23
24
21

DOCTORS FOR PAPER-MAKING MACHINES

For the efficient doctoring of rolls and cylinders in paper-making it is essential that the doctor blade should be in even contact with the roll surface over its whole length. Furthermore, it is desirable that the contact pressure should not vary unduly along the roll face.

It has been proposed to provide for compensation for camber or deflection of the roll or cylinder by making provision for local pivotal warping of the blade holder which carries the doctor blade, but this expedient is not very satisfactory because the holder is of fairly massive construction, does not easily distort and, being malleable, takes on a set when distorted.

It has also been proposed, in British Specification No. 1,226,160, to provide screws, spaced at intervals along the length of the blade holder, which can be adjusted to apply variable pressure at different points to a pressure plate disposed between the blade and the blade holder but this expedient tends to detract from the flexibility of the blade.

The present invention provides a doctor comprising a support, a blade holder including a tang, disposed adjacent the support, a doctor blade supported in the blade holder, the support and the tang having opposed flat surfaces, a series of spacers spaced along the length of the doctor, each of which is adjustable to vary the spacing between the said flat surfaces while maintaining them parallel, and means for securing each spacer in adjusted position.

Preferably the spacers are externally screw-threaded tubular nipples which are screwed into correspondingly screw-threaded holes in the tang and the securing means are screws which are fitted through the nipples into screw-threaded holes in the support and have heads which can be brought to bear against the blade holder.

By adjusting the nipples and securing them in adjusted position by means of the screws, the spacing between the tang and the support can be locally varied, thereby causing the blade holder to bend, as necessary to cause the tip of the blade to make contact at even pressure throughout its length with the roll or cylinder, without otherwise distorting the tang.

One embodiment of the invention is illustrated in the accompanying drawing. The doctor shown includes a doctor blade 10, which bears in use against a cylinder 11 to be doctored, and a blade holder made of two parts 12, 13 suitably secured together. Also accommodated in the blade are a pressure plate 14 and a keep plate 15. As described in British Specification No. 1,196,612, the pressure plate 14 bears against the side of the blade 10 facing the cylinder 11. The blade 10 and the pressure plate 14 carry respectively spaced rivets 16, 17 accommodated in grooves 18, 19 in the blade holder.

The part 12 of the blade holder includes a rearwardly projecting tang 20 having a flat undersurface disposed opposite a flat surface on a support 21 which is loaded in the conventional way to apply pressure to the blade 10 to urge it against the cylinder 11.

The spacing between the tang 20 and the support 21 is determined by a number of adjusting devices spaced along the width of the doctor and one only of which is shown in the drawing.

Each adjusting device comprises an externally screw-threaded nipple 22, which can be screwed by an Allen key into a hole in the tang 20 and bears against a flat surface 31 on the support 21 and a screw 23, which passes through the Allen key hole in the nipple 22 and is screwed into a hole 24 in the support 21 until its head 25 abuts the tang 20.

As previously explained, the nipples 22 are adjusted to vary the spacing between the flat surfaces 32, 31 on the tang 20 and the support 21, while maintaining them parallel, as required to vary the pressure applied by the blade holder to the blade 10 in such a way as to maintain the tip of the blade in even contact with the cylinder 11 over its whole length. When the adjustment to the nipple 22 has been made, the screw 23 is tightened against the tang 20 to lock the whole assembly in the desired position.

What I claim as my invention and desire to secure by Letters Patent is:

1. A doctor comprising a support, a blade holder including a tang, disposed adjacent the support, a doctor blade supported in the blade holder, the support and the tang having opposed flat surfaces, a series of spacers spaced along the length of the doctor, each of which is adjustable to vary the spacing between the said flat surfaces while maintaining them parallel, and means for securing each spacer in adjusted position.

2. A doctor according to claim 1, wherein the spacers are externally screw-threaded tubular nipples which are screwed into correspondingly screw-threaded holes in the tang and the securing means are screws which are fitted through the nipples into screw-threaded holes in the support and have heads which can be brought to bear against the blade holder.

* * * * *